United States Patent [19]

Klievoneit et al.

[11] Patent Number: 4,592,169

[45] Date of Patent: Jun. 3, 1986

[54] DISC GRINDER WITH FLOATING GRINDING WHEEL

[75] Inventors: Harold R. Klievoneit, Mesa; Augustine G. Esposito, Phoenix, both of Ariz.

[73] Assignee: St. Florian Company, Ltd., Phoenix, Ariz.

[21] Appl. No.: 698,322

[22] Filed: Feb. 5, 1985

Related U.S. Application Data

[63] Continuation of Ser. No. 638,376, Aug. 7, 1984, abandoned.

[51] Int. Cl.[4] ..... B24B 5/00

[52] U.S. Cl. ..... 51/118; 51/111 R; 51/117; 51/236; 51/237 R

[58] Field of Search ..... 51/111 R, 117, 118, 51/119, 120, 132, 168, 236 R, 237 R, 237 M, 281 SF

[56] References Cited

U.S. PATENT DOCUMENTS

| | | | |
|---|---|---|---|
| 1,634,745 | 7/1927 | Fraser | 51/117 |
| 1,870,328 | 8/1932 | Indge | 51/118 |
| 1,926,974 | 9/1933 | Einstein | 51/118 |
| 3,089,292 | 5/1963 | Hunt | 51/118 |
| 3,535,830 | 10/1970 | Keefe et al. | 51/236 |
| 3,676,957 | 7/1972 | Herckelbout | 51/118 |
| 3,845,587 | 11/1974 | Klievoneit | 51/118 |
| 3,859,756 | 1/1975 | Zerbola | 51/118 |
| 3,931,696 | 1/1976 | Lorenz et al. | 51/237 R |
| 4,208,842 | 6/1980 | Katzke et al. | 51/111 R |

*Primary Examiner*—Frederick R. Schmidt
*Assistant Examiner*—J. T. Zatarga
*Attorney, Agent, or Firm*—Cahill, Sutton & Thomas

[57] ABSTRACT

A grinding and polishing tool includes a pair of opposed grinding wheels for grinding or polishing simultaneously each of a plurality of discs located therebetween. Outer pulley wheels on a collar in cooperation with an inner pulley wheel support the discs peripherally and permit both rotation about and translation along the respective rotational axis of each disc in response to forces imposed by the grinding wheels. A uniform thickness of the discs is achieved by employing the discs themselves randomly distributed about the collar as spacers between the non-resilient grinding wheels to initially contact and grind the thicker discs until all discs are of equal thickness. Gimbal mounting one grinding wheel permits self-alignment thereof in a parallel relationship with the other grinding wheel to obtain parallel ground or polished surfaces on each disc.

17 Claims, 14 Drawing Figures

FIG. 8
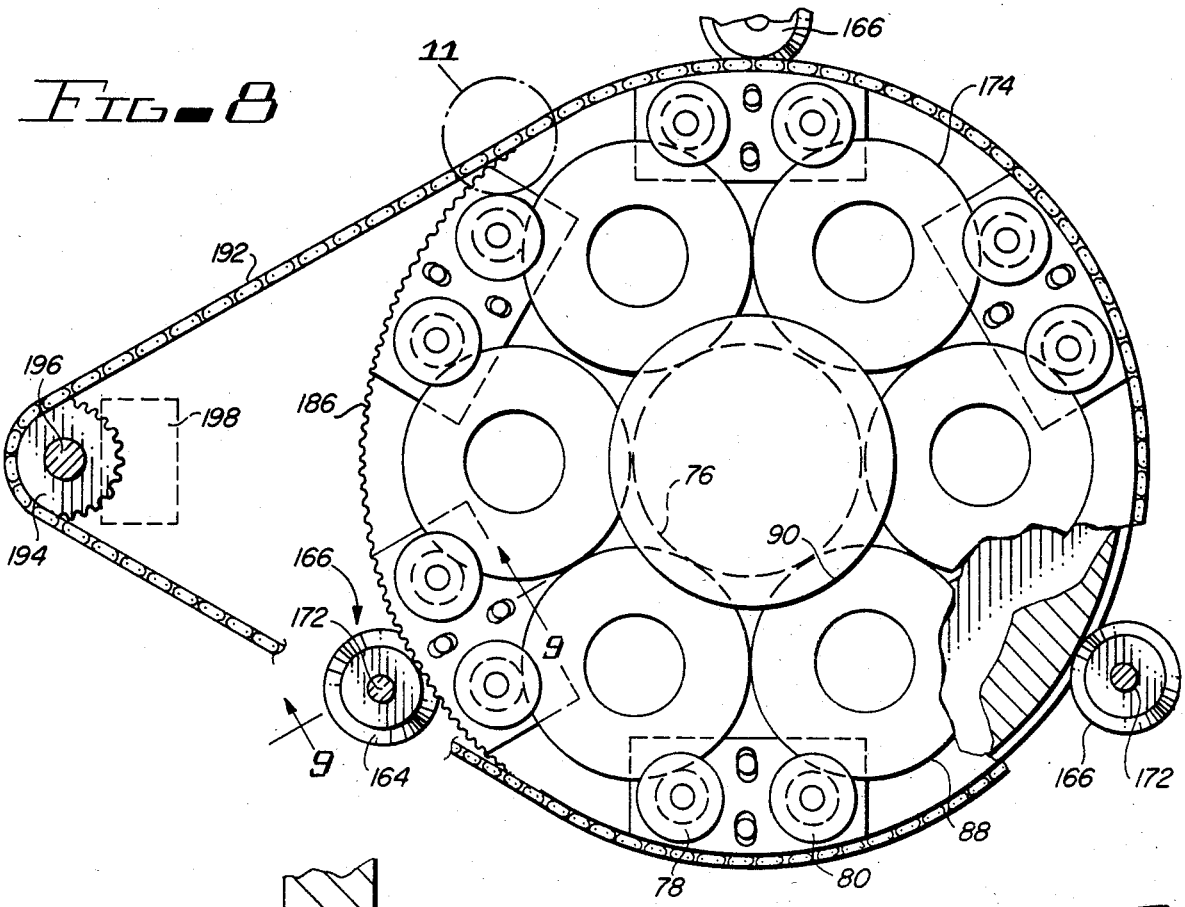
FIG. 9
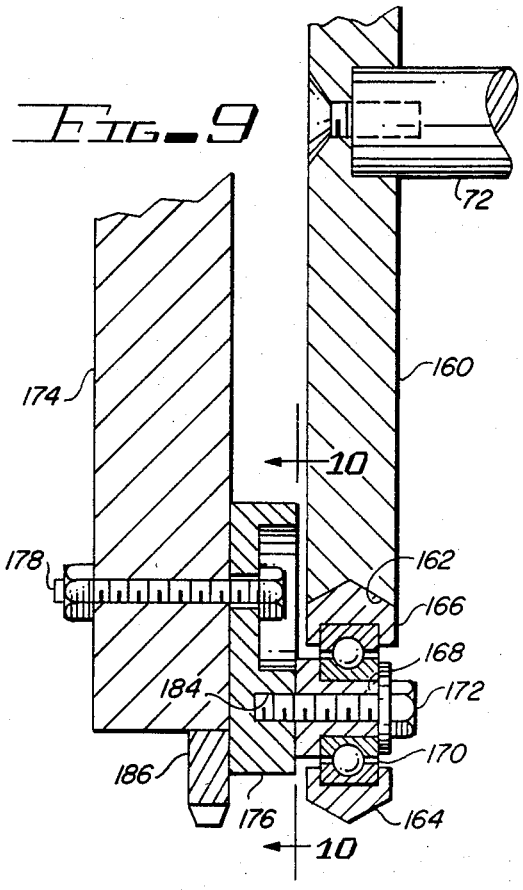
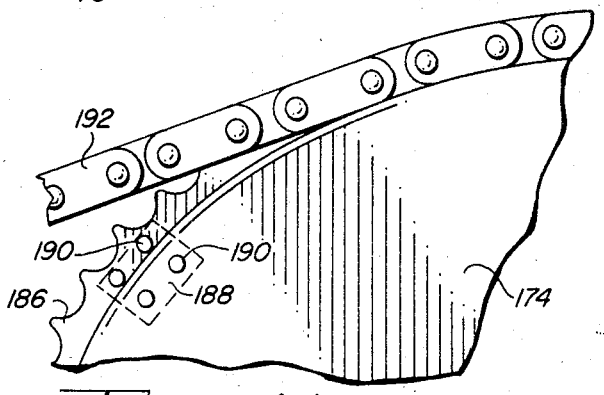
FIG. 11
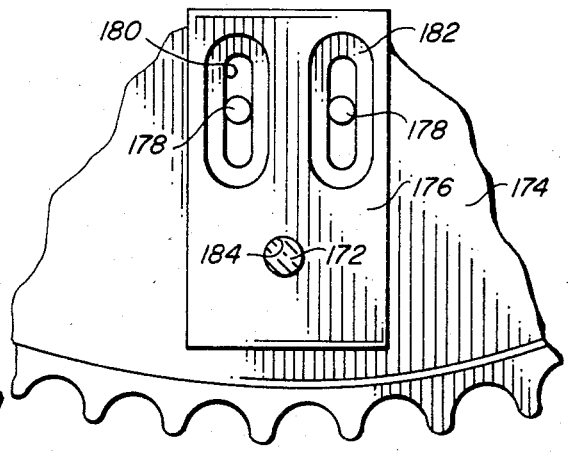
FIG. 10

FIG-12
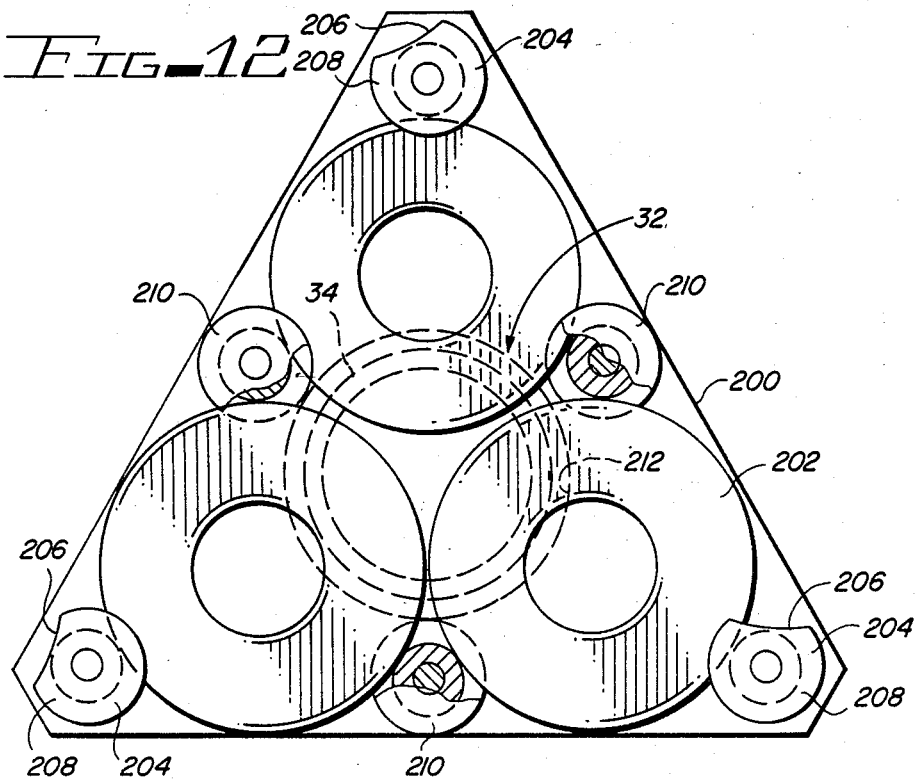
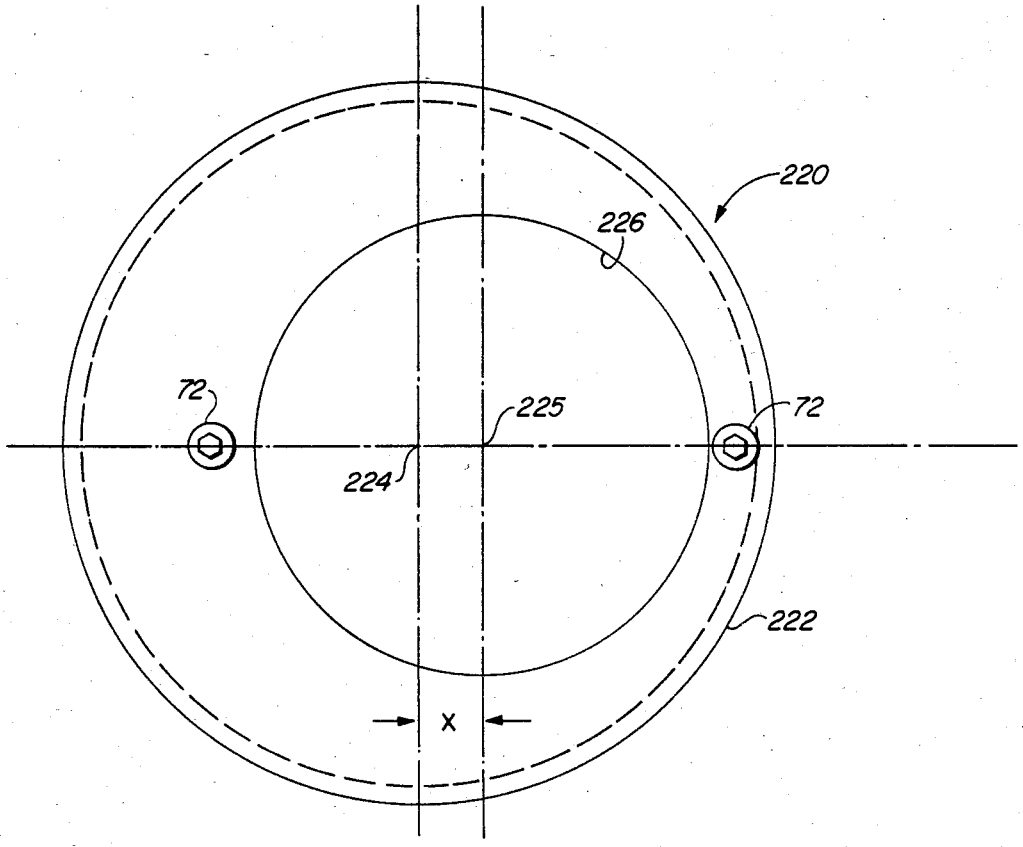
FIG-13

DISC GRINDER WITH FLOATING GRINDING WHEEL

This is a continuation, of application, Ser. No. 638,376, filed Aug. 7, 1984 now abandoned.

BACKGROUND OF THE INVENTION

1. Field of the Invention

The present invention relates to machine tools and, more particularly, to grinding and polishing tools for discs.

2. Description of the Prior Art

The computer industry employs rigid discs of various diameters for storage and retrieval of information encoded therein. The surfaces of these discs are scanned by close tolerance accurately positionable heads. The accuracy and density of the information storage and retrieval capability is a function of the degree of parallelism between opposed surfaces and the degree of finish on each surface. It is therefore very desirable to grind the discs to a high degree of parallelism between opposed sides, with each side being highly polished.

Various devices have been developed for truing the opposed sides of discs and grinding and polishing the respective surfaces. U.S. Pat. No. 3,845,587 is directed to a tool for spindle supporting each of a plurality of discs positioned intermediate extremely large sized and rigid grinding wheels. The opposed grinding wheels are dressed in situ and the grinding/polishing surfaces are maintained parallel to one another through employment of massive shafts, bearings and interconnecting framework. U.S. Pat. No. 1,656,820 is directed to a pair of grinding wheels having a vertically oriented axis of rotation. The upper grinding wheel rests upon the work piece being ground and the grinding force imparted thereto is a function of the weight of the grinding wheel and its spindle. U.S. Pat. No. 2,225,193 is directed to a grinding wheel having imbedded in the face thereof segmented abrasive elements. U.S. Pat. No. 2,371,021 is directed to a rotatable sanding or buffing tool which is preloaded. U.S. Pat. No. 2,826,877 is directed to a grinding and polishing element having a flexible intermediate member for preloading the grinding wheel. U.S. Pat. No. 3,676,957 is directed to apparatus for grinding helicoid springs. U.S. Pat. No. 3,668,812 is directed to a device for dressing the abrasive elements on a grinding wheel.

SUMMARY OF THE INVENTION

The grinding and polishing apparatus described herein includes a readily replaceable collar for supporting a plurality of uniform sized discs to be ground or polished. An axially repositionable grinding wheel cooperates with a gimballed grinding wheel rotating at a different rate of rotation to reduce the thickness of all of the discs to a uniform size and obtain parallelism between opposed sides of each disc. The disc supporting collar may be rotatably mounted to permit rotation of a set of discs at a rate which is a function of the rotational speed difference between the grinding wheels; the collar rotation speed may be reduced by a selectively actuatable drag brake. The use of a rotatable collar also aids in repositioning the discs for manual or mechanical disc mounting and demounting. And, the collar may be skewed off center to provide a continuously varying width swath being ground.

It is therefore a primary object of the present invention to provide a grinding tool for grinding to uniform thickness a set of discs.

Another object of the present invention is to provide a grinding tool for grinding parallel opposed surfaces on each disc of a set of discs.

Still another object of the present invention is to provide a collar for supporting a plurality of discs of uniform size intermediate a pair of opposed grinding wheels.

Yet another object of the present invention is to provide a disc mounting mechanism for rotatably supporting each of a plurality of discs at the respective perimeters thereof to permit both independent rotation and axial displacement of the discs commensurate with wear of grinding wheels acting thereupon.

A further object of the present invention is to provide a disc mounting collar axially offset of the axis of rotation of opposed grinding wheels to obtain more uniform grinding of each of the collar supported discs.

A yet further object of the present invention is to provide a selectively actuatable drag brake for restraining rotation of a disc supporting rotatable collar.

A still further object of the present invention is to provide a grinding tool for grinding a plurality of differently sized sets of discs by interchanging disc supporting collars.

These and other objects of the present invention will become apparent to those skilled in the art as the description thereof proceeds.

BRIEF DESCRIPTION OF THE DRAWINGS

The present invention will be described with greater specificity and clarity with reference to the drawings, in which:

FIG. 8 illustrates a collar drag brake mechanism;

FIG. 9 is a cross-sectional view taken along lines 9—9, as shown in FIG. 8;

FIG. 10 is a partial view of a collar mounting plate;

FIG. 11 is a partial cross-sectionl view illustrating the mounting of the collar sprocket depicted in FIG. 8;

FIG. 12 illustrates a variant of a disc supporting collar;

FIG. 13 illustrates off axis mounting of a disc supporting collar; and

FIG. 14 illustrates mounting of a floating inner wheel.

DESCRIPTION OF THE PREFERRED EMBODIMENTS

Figure 1:
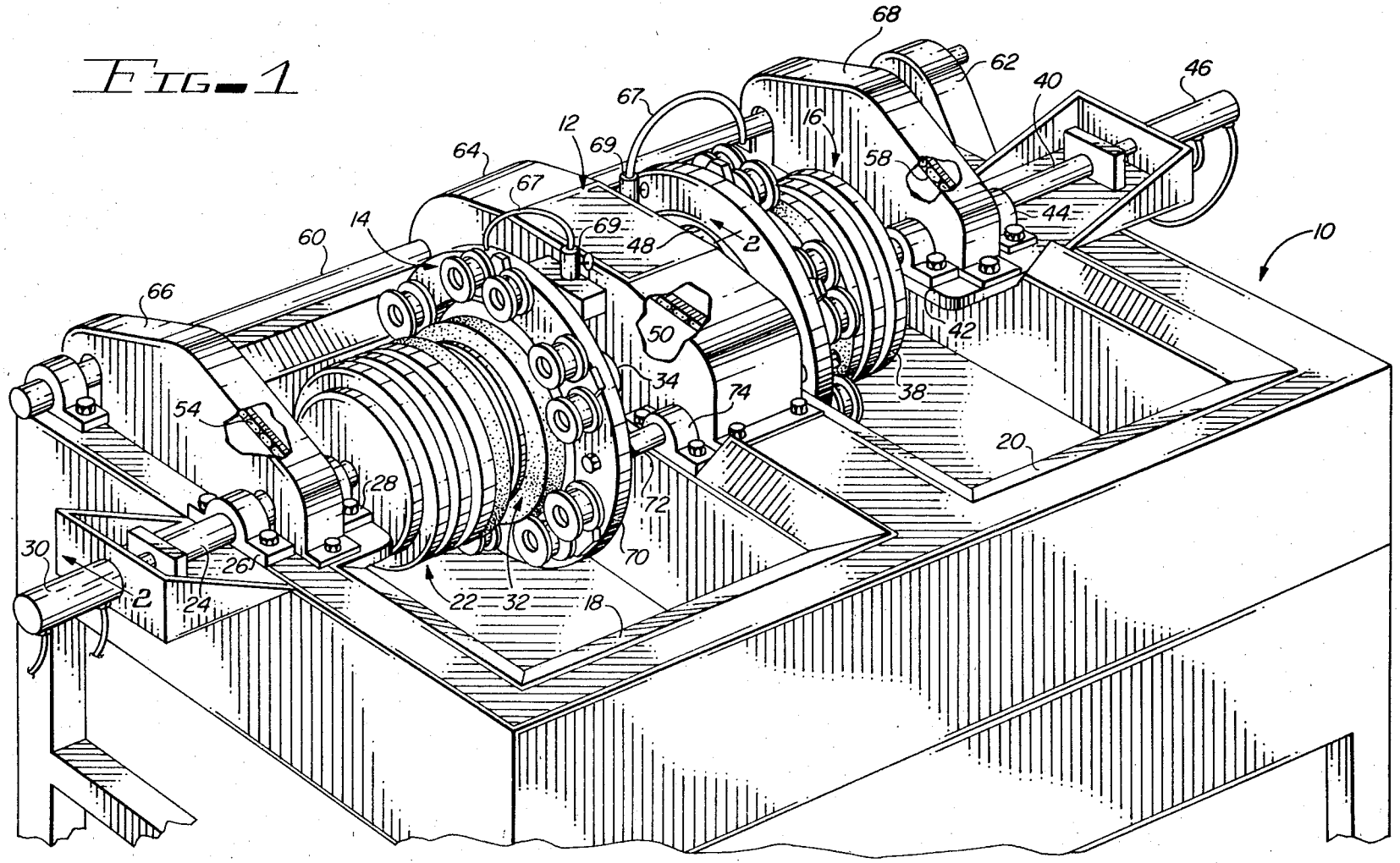
FIG. 1 illustrates a perspective view of the disc grinding machine tool.

Referring to FIG. 1, there is shown a robustly constructed frame 10 for supporting a two station disc grinding machine tool 12. First station 14, illustrated on the left side of the figure, may be used for grinding each of a plurality of discs. Second station 16, illustrated on the right side of the figure, may be used for polishing each of a plurality of discs. Various embodiments of the machine tool may be configured whereby both stations can operate concurrently but independently of one another or in concert with one another. In the following description, the details of the invention will be primarily directed to station 14; it being understood that station 16 is essentially a duplicate or mirror image thereof.

Discs used in the computer field for data storage and retrieval purposes operate most accurately if the opposed surfaces are truely parallel to one another and of a smoothness exceeding that of three microns and highly polished. Grinding and polishing discs for such tolerances requires highly specialized equipment to be able to do it on a commercial basis.

Frame 10 is purposely built extremely robust and rigid to provide a firm foundation for the plurality of axially aligned grinding wheel supporting and rotating shafts. Any misalignment of such shafts, and more so any movement of the shafts lateral to the axis of rotation, will produce deviant grinding/polishing results which are intolerable. Vats 18, 20 are located within frame 10 to collect the oil discharged upon the discs during grinding at stations 14, 16, respectively.

Station 14 of machine tool 12 includes an outer grinding wheel 22 supported upon a shaft 24 rotatably mounted within pillow blocks 26, 28. Hydraulic means 30, or other regulatable repositioning means, is employed to axially reposition shaft 24 and grinding wheel 22, on command. Inner grinding wheel 32 is supported upon a shaft 34 (see FIG. 2) rotatably mounted within pillow blocks, of which one pillow block is illustrated. Station 16 includes an outer grinding wheel 38 supported upon axially displaceable shaft 40, the latter being mounted within pillow blocks 42, 44. Hydraulic means 46, or the like, is employed to axially reposition shaft 40 on command. An inner grinding wheel 48 is also mounted upon shaft 34 (see FIG. 2).

The rotational drive mechanism for the grinding wheels will be described with joint reference to FIGS. 1 and 2. Shaft 34 is rotatably driven through a chain 50 and sprocket 52 mounted on shaft 34. Shaft 24 is driven by a belt 54 engaging a pulley 56 mounted on the shaft. A belt 58 is attached to a pulley mounted on shaft 40. Chain 50 and belts 54, 58 are driven through appropriate sprocket and pulleys nonrotatably mounted upon a common rotary shaft 60. Shaft 60 is rotated through a chain and sprocket mechanism 62 by a drive motor. For safety purposes, chain 50 and its engaged sprockets are housed within a cover 64. Covers 66, 68 envelope belts 54, 58 and their pulleys, respectively.

It is preferable that the rotational speed of the grind wheels of any opposed pair of grinding wheels be different; otherwise, waves in the element to be ground are likely to develop. To assure nonsynchronous rotation, the drive mechanism or shaft 34 supporting the inner grinding wheels is of a nonslipping chain and sprocket type. The drive mechanisms for each of the outer grinding wheels are of the belt and pulley type which inherently cause some slippage and with loading cause further slippage. Thus, even if the gear ratios of the chain and sprocket and belt and pulley mechanisms are identical, the rotational speed of the respective driven shafts will be out of synchronization due to the slippage inherent in belt drives.

To aid the grinding/polishing process, oil is continually ejected upon discs through a tube 67. The oil flowing therefrom may be directed upon the adjacent discs, wherefrom it is transferred to the grinding wheels and remaining discs by gravity and certrifugal force. A stop cock 69 or other means can be incorporated to control the flow rates, etc.

Figure 2:
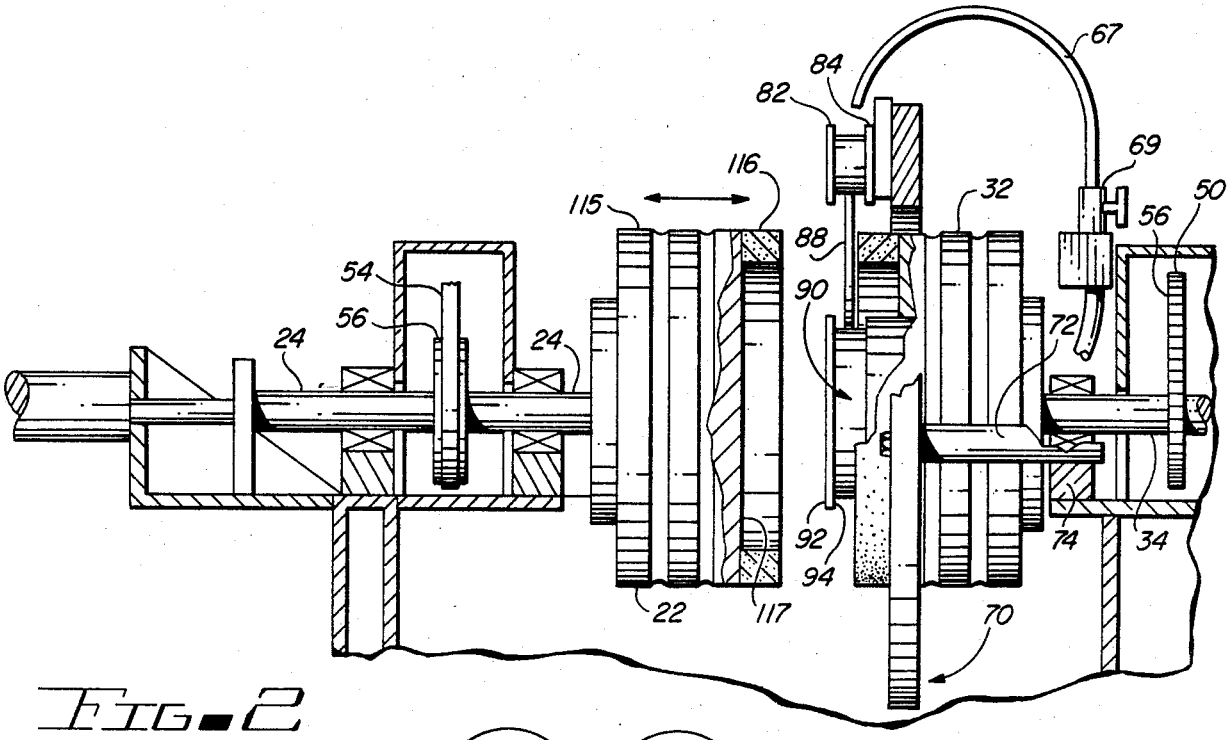
FIG. 2 is a partial cross-sectional view taken along lines 2—2, as shown in FIG. 1.
Figure 3:
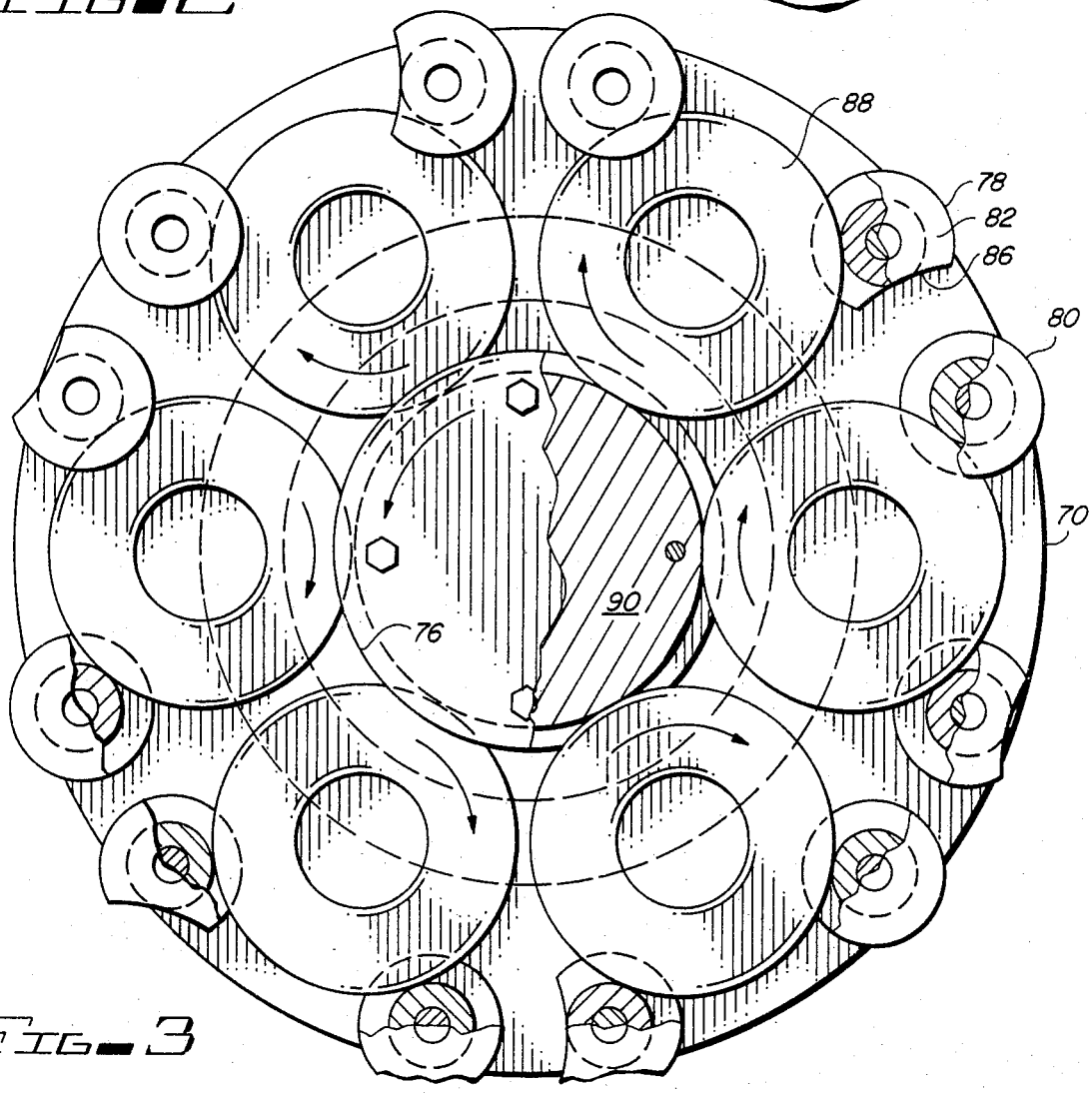
FIG. 3 is a partial view of a disc supporting collar.

Referring jointly to FIGS. 1, 2 and 3, the means for supporting a set of discs at each station will be described. A collar 70 is rigidly attached to a pair of studs, of which stud 72 is illustrated. These studs may be located diametrically opposed and lateral of inner grinding wheel 32. A means for mounting the studs may be by clamping each stud within a pillow block such as pillow block 74 illustrated. A central aperture 76 is formed within the collar. A plurality of pairs of pulley wheels 78, 80 are rotatably mounted adjacent the perimeter of collar 70. Each of these pulley wheels includes annular rails 82, 84, each of which rails has a slightly inwardly sloping inner radial surface. Rail 82 of each of pulleys 78 includes an arched or straight line indentation 86, the purpose of which will be described below. As particularly illustrated in FIG. 3, each of discs 88 are supported at two points by one of pairs of wheels 78, 80 and another of the adjacent pairs of pulley wheels. The third point of support for each of discs 88 is provided by a central pulley wheel 90, which is affixed to grinding wheel 32 in axial alignment therewith. The pulley wheel includes an annular flange 92 having an inner surface 94 of a slight inward slope. By having the inside surfaces of the rails of all pulley wheels slightly tapered, only the peripheral edge of the disc will come in contact therewith and no wear band attendant the sides of the discs can or will be formed.

The spacing intermediate rails 82, 84 of pulley wheels 78, 80 and flange 92 of pulley wheel 90 permit travel of discs 88 in a direction along the axis of rotation of the discs. Removal of the discs laterally is precluded by the three point support for the discs. To mount and demount each disc, the respective pulley wheel 78 is rotated to position indentation 86 in alignment with the perimeter of the respective disc. As the arc of indentation 86 is equivalent to the curvature of the disc perimeter, displacement of the edge of the disc past rail 82 may be effected. Upon each displacement, the disc may be demounted as the remaining contact is then limited to that of pulley wheel 80 and pulley wheel 90. In normal operation, the forces imposed upon disc 88 will not cause the disc to be relocated laterally at any instant during which it may be in coincidence with indentation 86.

Figure 4:
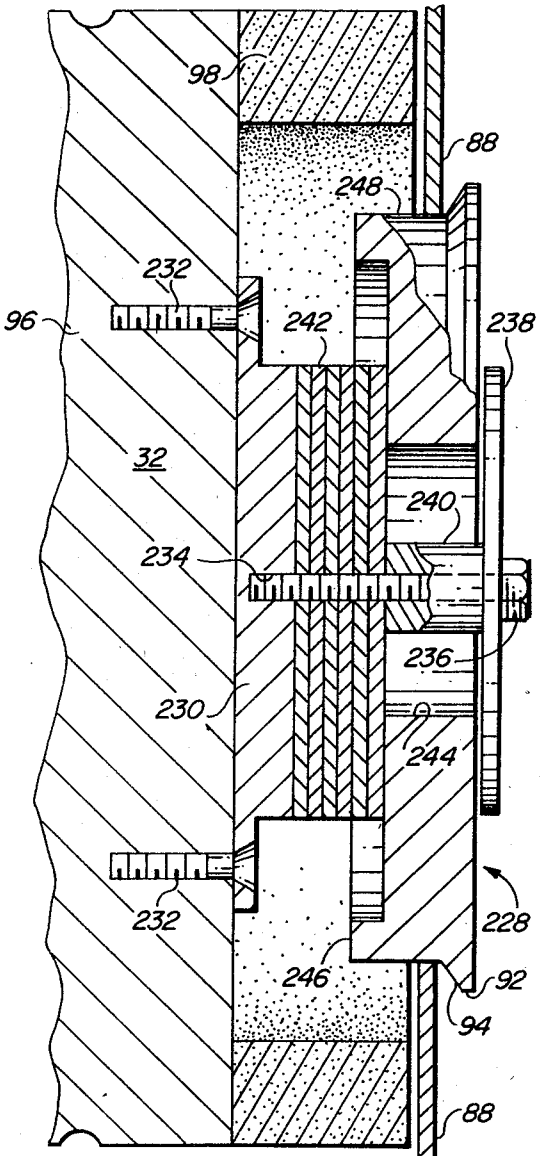
FIG. 4 is a partial cross-sectional view of a grinding wheel and an attached disc supporting inner wheel.
Figure 4:
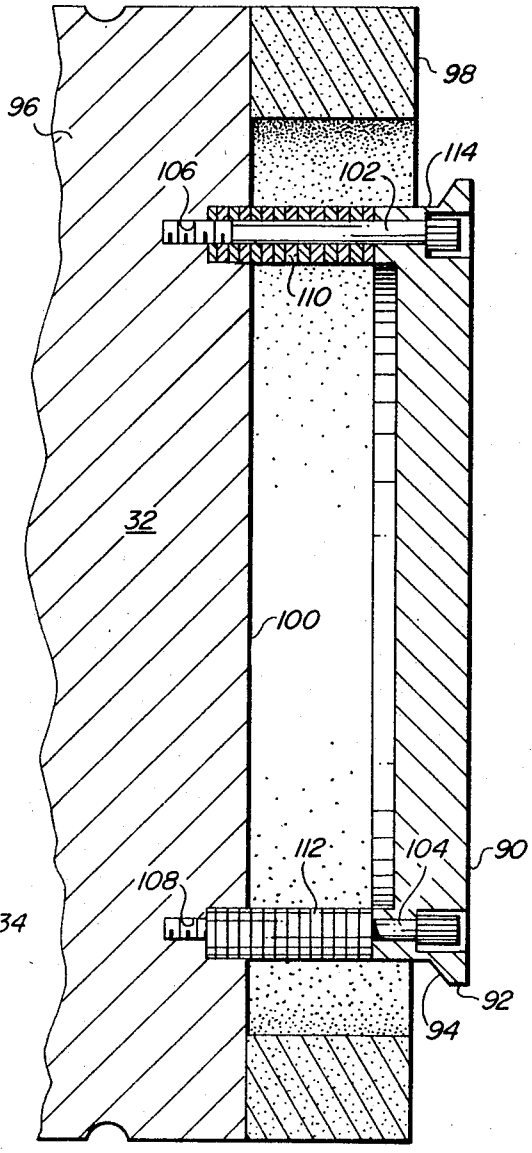

The mounting of pulley wheel 90 upon grinding wheel 32 will be described with specific reference to FIG. 4. Grinding wheel 32 includes a massively constructed head 98 of aluminum or similar material. The massive construction of the head essentially precludes any measurable deformation or resilience thereof during normal operation. A grinding or polishing medium 98 is attached in a ring-like configuration on face 100 of head 96 and extends inwardly from the perimeter a given distance.

A pair of bolts 102, 104 are recessed within and extend through pulley wheel 90 for threaded engagement with threaded cavities 106, 108 within head 96. The pulley wheel is spaced from face 100 by use of a plurality of spacers 110, 112 penetrably engaged by bolts 102, 104, respectively. The width of perimeter surface 114 of pulley wheel 90 may be configured to be somewhat greater than the width between rails 82, 84 of pulley wheels 78, 80; the width of which is, in turn, controlled by the amount of wear of the grinding medium tolerable before readjustment of the position of the collar in the axial direction is necessitated. In practice, the width of perimeter surface 114 is substantially less than the width of grinding medium 98. Accordingly, repositioning of pulley wheel 90 and collar 70 is necessitated periodically as grinding medium 98 wears away. Such repositioning is effected by periodic removal of spacers 110, 112 and repositioning of the collar supporting studs.

The preferred horizontal spacing maintained between inner surface 94 of pulley wheel 90 and the working surface of grinding medium 98 is somewhat greater than the width of the discs being ground to preclude forced contact of the discs with inner surface 94 and to provide limited play for mounting and demounting of the discs in contact with perimeter surface 114. To maintain such relatively small spacing during wear of grinding medium 98, it becomes necessary to periodically relocate pulley wheel 90 toward head 32. Such relocation is effected by periodic removal of spacers 110, 112. The axial excursion of the discs resulting from wear of grinding medium 98 is accommodated by pulley wheels 78, 80 through appropriate spacing between rails 82, 84. Accordingly, pulley wheels 78, 80 need not be relocated despite wear within a relatively large range of the grinding medium.

Referring momentarily to FIG. 2, grinding wheel 22 includes a massive head 115 of turned aluminum or the like. A ring of grinding medium 116 is attached to surface 117 of the head. The grinding wheel is rigidly attached to shaft 24 by conventional means well known to those skilled in the art.

Figure 5:
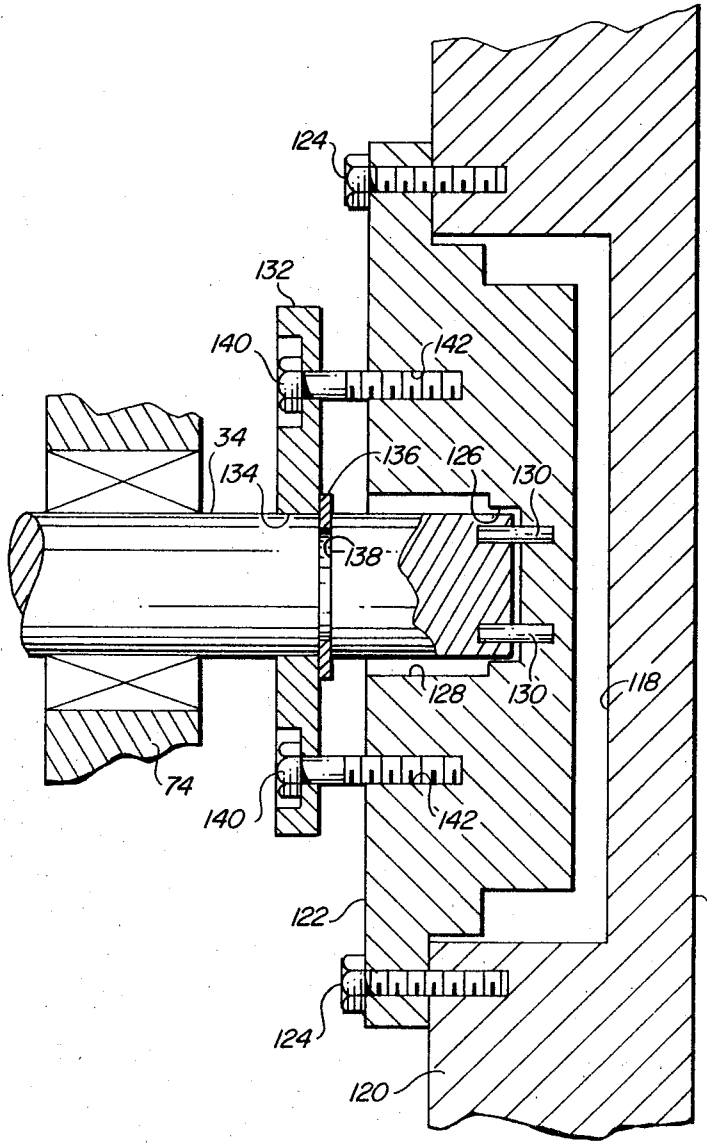
FIG. 5 illustrates a gimbal mounted grinding wheel.

Referring to FIG. 5, there is shown a mounting means for grinding wheel 32 which mounting means is in the nature of a gimbal mounting. An axial recess 118 is formed in rear face 120 of the grinding wheel. A support plate 122 is placed partially within recess 118 and is rigidly attached to rear face 120 by bolts 124. The support plate includes a circular cavity 126 configured slightly larger in diameter than the diameter of shaft 34. The cavity includes an annularly enlarged section 128 to preclude contact of shaft 34 with most of the length of the wall of cavity 126. Each of pins 130 nest within a portion of support plate 122 and the end of shaft 34 and serve as translation members to effect rotational movement of grinding wheel 32 commensurate with rotation of shaft 34. Because shaft 34 does not fit snugly within cavity 126, some angular movement of grinding wheel 32 off the axis of rotation of shaft 34 is possible; the extent of such angular movement is a function of the degree of tolerance between cavity 126 and the diameter of shaft 34.

Support plate 126, and hence grinding wheel 32, is maintained mounted upon shaft 34 by means of a keeper plate 132. The keeper plate includes a central aperture 134 for loosely penetrably receiving shaft 34. A snap ring 136, or the like engages a groove 138 about shaft 34. The resulting interference between the keeper plate and the snap ring precludes further movement of the keeper plate toward the end of the shaft. Four bolts 140 equiangularly spaced about the keeper plate threadedly engage respective apertured cavities 142 in the support plate. Accordingly, movement of grinding wheel 32 along the axis of rotation of shaft 34 is precluded by the mechanical engagement between the keeper plate and the snap ring.

In practice, grinding wheel 32 is mounted upon shaft 34 by drawing support plate 122 toward keeper plate 134 through equal turns of each of bolts 140. Thereby, parallelism between the keeper plate, support plate and disc grinding wheel 34 is achieved. However, as the keeper plate is not fixedly attached to the shaft, it has sufficient freedom of movement to accommodate some "rocking" commensurate with the angular movement of head 96 afforded by the end of the shaft disposed within cavity 126. In this manner, grinding wheel 32 is gimbal mounted upon shaft 34.

Figure 7:
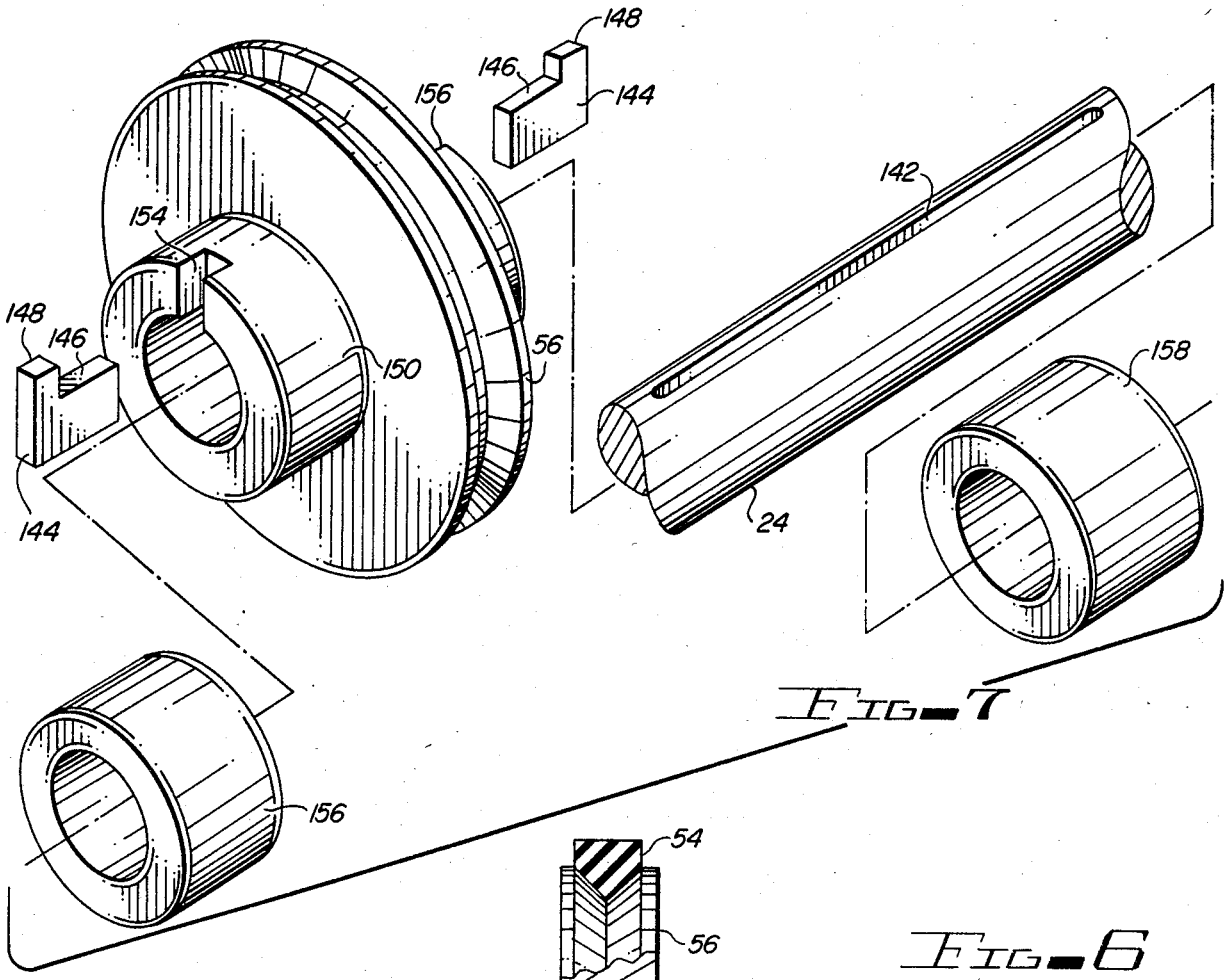
FIG. 7 is an exploded view of a shaft and a driver pulley attached thereto.
Figure 6:
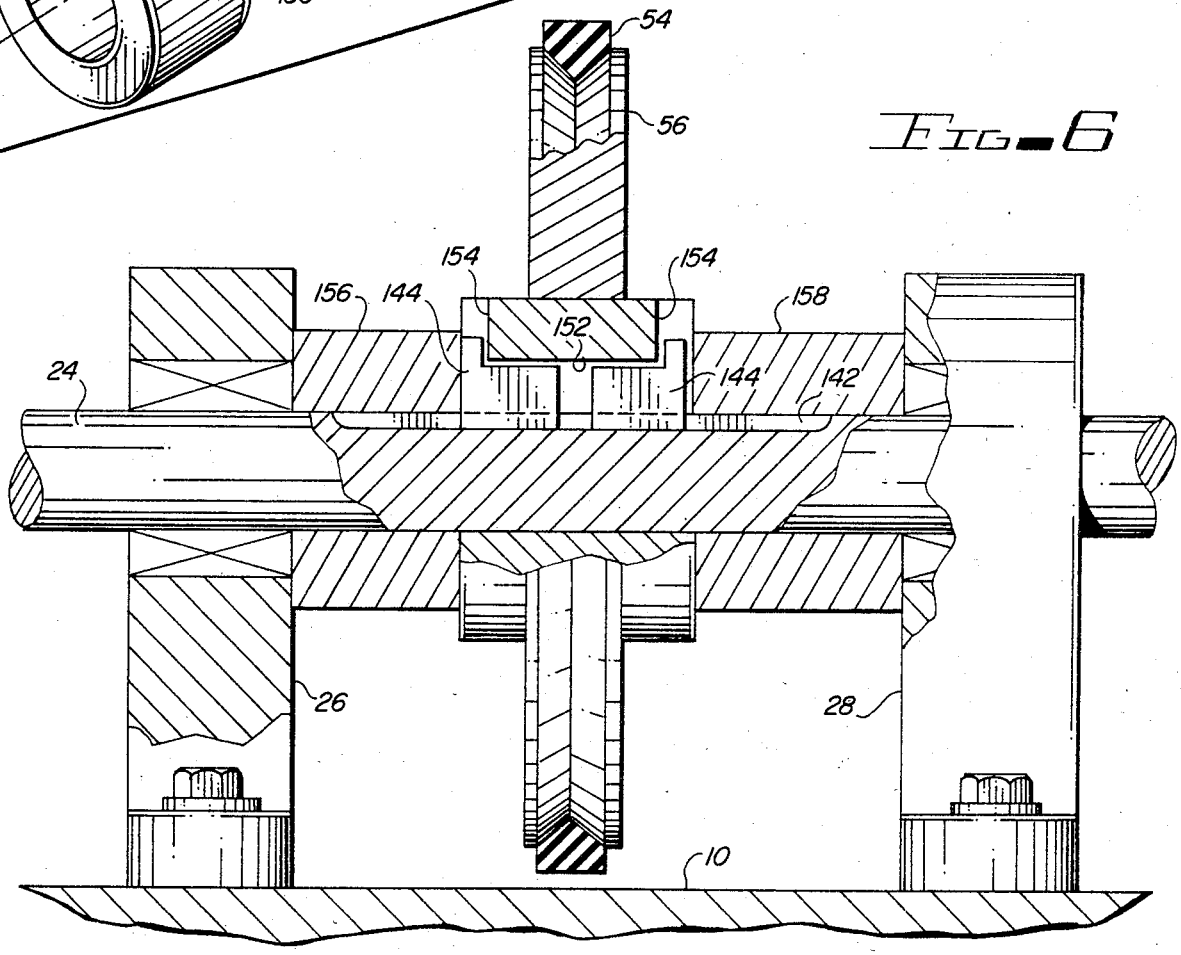
FIG. 6 illustrates the mounting for a drive pulley on a grinding wheel shaft.

Referring jointly to FIGS. 6 and 7, a means employed for rigidly mounting the belt driven pulleys upon their respective shafts will be described. It is to be understood that while the structure attendant shaft 24 will be described specifically, similar structure is employed attendant shaft 40. Shaft 24 is formed with an axially aligned groove 142 adapted to slidably receive a pair of oppositely oriented dogs 144, which dogs are L-shaped and include a base 146 and a leg 148. Hub 150 of pulley 56 includes an internal radially oriented groove 152 configured to snuggly receive bases 146 of opposed dogs 144. Additionally, the outward edges of hub 150 are indented by radially aligned indentations 154 to snuggly receive legs 148 of the respective dogs. Collars 156, 158 positionally retain the hub on shaft 24 and maintain legs 148 of the dogs within respective indentations 154. It is to be understood that hub 150 slidably receives shaft 24 whereby movement of pulley 56 along the shaft may be effected with relative ease.

To lock pulley 56 upon shaft 24, the shaft is penetrably engaged with hub 150. Dogs 144 are placed within groove 142 and slid into the hub within groove 152 and respective indentations 154. Thereafter, rotation of pulley 56 independent of shaft 24 is precluded. Pulley 56 is driven by belt 54 which belt is an engagement with a pulley mounted on shaft 60 (see FIG. 1). Accordingly, pulley 56 must be maintained in general alignment with the belt and the respective pulley mounted upon shaft 60. To maintain such alignment of pulley 56 despite movement of shaft 24 along its axis of rotation, a pair of spacers position hub 150 intermediate pillow blocks 26, 28. Thereby, axial repositioning of shaft 24 will not cause relocation of pulley 56 yet a rotational force imparted by the pulley to the shaft will be continuously maintained during any axial movement of the shaft.

By rotating, rather than rigidly mounting, collar 70, certain benefits are achieved. First, an operator will have axis to each of the disc positions by simply turning the collar until each disc position comes within easy reach. At such position the operator may readily mount or demount the respective disc. Secondly, limited rotation of the collar will have at least a tendency to produce a more fine grind or polish upon the discs. The collar may not be freely rotating or else it will rotate commensurate with rotation of the grinding wheels, except as modified by the slight rotational speed difference therebetween, and grinding of the discs will not be effected. Therefore, a drag brake or retardation means acting upon the collar is preferable. It is to be understood that such drag brake or retardation means is preferably configured not to be an impediment to an operator manually rotating the collar.

Referring primarily to FIGS. 8, 9, 10 and 11, the means for rotatably mounting the collar and applying a drag brake or retardation force thereto will be described. A mounting ring 160 is attached to the studs previously described with respect to collar 70 and of which stud 72 is illustrated. A groove 162 is developed in the perimeter of mounting ring 160 to receive a commensurately configured perimeter 164 of a wheel 166. The wheel is rotatably mounted upon a stud 168 through a bearing 170 and secured in place by a bolt 172. A collar 174, similar in function and configuration with collar 70 described above, supports each of a plurality of discs 88 by pulleys 78, 80 and pulley wheel 90, as described above. It is to be understood that collar 174 is centrally apertured by aperture 76 to accommodate grinding wheel 32 and pulley wheel 90. A mounting plate 176 is adjustably attached to collar 174 by nut and bolt means 178 extending through each of slots 180, 182. The mounting plate also includes a threaded cavity 184 for threadedly engaging bolt 172 whereby the bolt secures stud 168 to the mounting plate. Slots 180, 182 in the mounting plate provide an adjustment capability for centrally mounting collar 174 with respect to ring 160 and for providing adequate and requisite clearance for rotational engagement of wheels 168 with groove 162. From the above description, it becomes apparent that collar 174 is free to rotate about fixed mounting ring 160.

Rotational restraint upon collar 174 is provided by means of a chain and sprocket arrangement. An annular sprocket 186 is attached to the perimeter of collar 174 by a plurality of plates 188 extending between the collar and annular sprocket and attached thereto by attachment means 190, such as nut and bolt combinations, rivets, etc. A chain 192 interconnects annular sprocket 186 with a sprocket wheel 194 mounted upon a shaft 196. To retard or place a drag upon rotation of collar 174, any number of mechanisms 198 may be employed. One such mechanism might be a brake acting upon sprocket 194 to retard rotational movement thereof. Alternatively, a mechanical brake, eddy current generator, etc., may be attached to shaft 196 directly, or flange extending therefrom, etc., the selection of which is well known to those skilled in the art.

The utility of grinding tool 12 may be greatly enhanced by adaptations of variants thereof which permit grinding and polishing of several differently sized discs. In example, the computer industry presently employs discs of 5¼" diameter, 8" diameter and 14" diameter. The grinding tool described herein can accommodate grinding and polishing of each of these sizes of discs. In the preceding description, the structure illustrated is particularly adapted for grinding a set of 5¼" discs. To grind 8" discs, collar 70 (or collar 174) need be enlarged by only a few inches to accommodate a number of 8" discs. To grind 14" discs, collar 200 illustrated in FIG. 12 is particularly well adapted.

Collar 200 is essentially a triangular plate fixedly attachable to the mounting studs, of which stud 72 is shown in FIG. 1. To grind 14" discs, support for the three discs 202 illustrated is provided by six pulley wheels. Pulley wheels 204 rotatably mounted at each of the apexes of collar 200 include indentations 206 in rails 208 in the manner of pulley wheels 78 described above. Thereby, removal of each disc 202 may be effected by rotating the respective pulley 204 until indentation 206 is coincident with the perimeter of the disc and thereafter relocating the disc laterally to disengage it from the pulley. Each of rotatably mounted pulleys 210 support two adjacent discs. Thereby, a three point support is provided for each of the three 14" discs illustrated. Necessarily, pulley wheel 90, mountable upon grinding wheel 32, is removed in order to provide the requisite clearance for the discs. Collar 200 is centrally apertured by aperture 212 to permit penetration therethrough of grinding wheel 32.

In the previously described collar 70 for 5¼" discs, the width of the swath ground or polished by the grinding wheels remained constant since the distance between the center of rotation of the grinding wheels and the center of rotation of each disc was maintained constant, irrespective of whether the collar revolved about the axis of the grinding wheels. By varying the width of the swath ground by the grinding wheels, it is possible to obtain a slightly finer and more smooth finish.

Referring to FIG. 13, there is illustrated a collar 220 for mounting a plurality of discs, which mounting means is duplicative of that shown in FIG. 3 with respect to collar 70. Collar 220 is attached to machine tool 12 by mounting it upon studs 72, in the manner described above. Perimeter 222 of collar 220 has a center 224, which center is not coincident with the axis of rotation of the grinding wheels. Center 225 of interior aperture 226 is coincident with the axis of rotation of grinding wheel 32 in the manner of aperture 76 of collar 70. The size of aperture 226 is greater than that of grinding wheel 32 in the manner of aperture 76 of collar 70. However, center 225 of aperture 226 is offset from center 224 of the collar by a distance defined by the letter "X", as shown in the drawing. The displacement or offset "X" is a function of the maximum width swath upon the discs to be ground provided that a certain minimum width swath is also maintained.

The mounting of pulley wheel 228 upon inner grinding wheel 32 in order to accommodate the off center mounting of the set of discs will be described with primary reference to FIG. 14. Grinding/polishing medium 98 is attached to head 96, as described above. A mounting plate 230 is centrally attached to head 96 by means of countersunk bolts 232, or the like. The mounting plate includes a threaded aperture 234 for receiving the threaded shaft of a retaining bolt 236. A retaining plate 238 is penetrably mounted upon bolt 236 and bears against a sleeve 240, which sleeve bears against one or more spacers 242. The resulting structure defines a space of fixed width intermediate retainer plate 238 and outermost spacer 242, which width is defined by the length of sleeve 240. Pulley wheel 228 includes an enlarged central aperture 244 for penetrably receiving sleeve 240. The thickness of the pulley wheel interior of annular flange 246 is made somewhat less than the length of sleeve 240. Thereby, retaining plate 238, assuming it has a radius greater than the diameter of aperture 244, will retain pulley wheel 228 juxtaposed with the outermost one of spacers 242 in a loose fit. The loose fit, in combination with enlarged aperture 244, accommodate radial repositioning of pulley wheel 228 due to any forces imposed upon its perimeter. As described above, discs 88 bear upon and are supported by peripheral band 248 of the pulley wheel.

Collar 220 will be skewed in one direction from the axis of rotation of the grinding wheels by the set of discs mounted thereon by an amount equivalent to "X". That is, the offset in axis of rotation between the grinding wheels and the collar, distance "X", is accommodated by the radial translation available to pulley wheel 228 whereby the previously discussed three point support for the discs is continuously maintained. Accordingly, collar 220, which is rotatable by mounting it on apparatus described primarily with reference to FIGS. 9, 10, 11 and 12, will cause the discs mounted thereon to travel on a circular path eccentric to the axis of rotation of the grinding wheels. Such travel results in cyclical radial travel of the discs with respect to the grinding wheels and varies the width of the swath being ground or polished.

From the above description, it may be evident that machine tool 12 may be readily adapted to grind differently sized discs simply by mounting an appropriately sized or configured collar. And, the swath being ground or polished may be continuously varied. The resulting versatility of the machine tool is immeasurably enhanced.

As will be evident by inspection, grinding wheel 22 is essentially and practically totally nonresilient and nondeforming during the grinding operation. Accordingly, the face of the grinding wheel is and will be maintained in a nonchanging, nonaltering planar relationship. In prior art grinding tools it was usually necessary to rigidly mount both opposed grinding wheels with massive structure such that the face of each grinding wheel was always maintained parallel to the opposing face to maintain them parallel with one another. By gimbal mounting grinding wheel 32, it is capable of continuing angular adjustment to maintain the face thereof continuously parallel with the face of grinding wheel 22. Thus, the rigid mounting structures attendant prior art devices are obviated.

The parallel relationship between the opposing faces of the grinding wheels is established by the discs being ground themselves. That is, by random mounting of discs of somewhat different thicknesses, a concentration of the more thick discs on one side of the collar will not occur. Accordingly, the discs themselves will act as spacers between the grinding wheels and the more thick discs will be ground down until all discs are of the same thickness. The nongrinding of the less thick discs initially is precluded by the robust nature of the head of each of grinding wheel which precludes any localized deformation or bending of the heads. The end result in that of obtaining not only discs of uniform thickness but discs having opposed sides essentially absolutely parallel with one another.

The operation of grinding tool 12 is controlled by automated controls which periodically reverse the rotation of direction, axially reposition the outer grinding wheel pertinent to mounting and demounting and insure that rotation of the grinding wheels continues through the make and break contact with the discs to avoid localized overgrinding. Moreover, the extent and application of load, axially directed, can be closely regulated commensurate with rotational acceleration/decceleration and reversal of rotation. By periodically reversing rotation, the grinding media tend to be self-dressing and thereby avoid down time of machine tool 12 due to dressing.

While the principles of the invention have now been made clear in an illustrative embodiment, there will be immediately obvious to those skilled in the art many modifications of structure, arrangement, proportions, elements, materials, and components, used in the practice of the invention which are particularly adapted for specific environments and operating requirements without departing from those principles.

We claim:

1. A machine tool for grinding and polishing a plurality of discs simultaneously, said machine tool comprising in combination:

(a) a first grinding wheel having an abrasive medium defining a plane for grinding one surface of the plurality of discs;

(b) a second grinding wheel having an abrasive medium defining a plane for grinding another surface of the plurality of discs;

(c) means for rotating said first and second grinding wheels about first and second axis of rotation, respectively;

(d) means for rotatably supporting each of a plurality of discs, for positioning each of the plurality of discs intermediate said first and second grinding wheels and for maintaining the plurality of discs simultaneously intermediate said first and second grinding wheels, said supporting and positioning means includes a plurality of freely rotatable pulley wheels for operative engagement with the perimeters of respective ones of the discs; and (e) means for accommodating continuous self-alignment of said second grinding wheel to locate the plane of the abrasive medium attendant said second grinding wheel in parallel alignment with the plane of the abrasive medium attendant said first grinding wheel and to grind the surfaces of the discs parallel with one another.

2. The machine tool as set forth in claim 1 wherein selected ones of said plurality of pulley wheels provide three point support for each of the discs..

3. The machine tool as set forth in claim 2 including means incorporated in said supporting and positioning means for accommodating lateral tilting of each of the discs to permit mounting and demounting of the discs.

4. The machine tool as set forth in claim 1 wherein said supporting and positioning means includes a centrally apertured collar for supporting said pulley means.

5. The machine tool as set forth in claim 4 including a further pulley wheel rotatably mounted within the aperture of said collar for supporting the discs in combination with said pulley wheels on said collar.

6. The machine tool as set forth in claim 5 wherein each of said pulley wheels and said further pulley wheel includes means for accommodating axial translation of the discs in response to wear of the abrasive medium disposed upon said first and second grinding wheels.

7. The machine tool as set forth in claim 6 wherein said further pulley wheel includes means for mounting it upon one of said first and second grinding wheels.

8. The machine tool as set forth in claim 7 wherein said collar is removably secured to said machine tool through a pair of studs.

9. A machine tool for grinding and polishing a plurality of discs simultaneously, said machine tool comprising in combination:

(a) a first grinding wheel having an abrasive medium defining a plane for grinding one surface of the plurality of discs;

(b) a second grinding wheel having an abrasive medium defining a plane for grinding another surface of the plurality of discs;

(c) means for rotating said first and second grinding wheels about first and second axis of rotation, respectively;

(d) means for rotatably supporting each of a plurality of discs, for positioning each of the plurality of discs intermediate said first and second grinding wheels and for maintaining the plurality of discs simultaneously intermediate said first and second grinding wheels, said supporting, positioning and maintaining means including a plurality of freely rotatable pulley wheels for operative engagement with the perimeters of respective ones of the discs;

(e) means for accommodating continuous self-alignment of said second grinding wheel to locate the plane of the abrasive medium attendant said second grinding wheel in parallel alignment with the plane of the abrasive medium attendant said first grinding wheel and to grind the surfaces of the discs parallel with one another; and (f) means for rotating said supporting and positioning means to permit rotation of the plurality of discs as a unit as well as rotation of each disc about its own axis of rotation in response to the forces applied to the plurality of discs by said first and second grinding wheels, said rotating means comprising a mounting ring secured to said machine tool, a centrally apertured collar and means for rotatably attaching said collar to said mounting ring.

10. The machine tool as set forth in claim 9 including a further pulley wheel rotatably mounted within the aperture of said collar for supporting the discs in combination with said plurality of pulley wheels on said collar.

11. The machine tool as set forth in claim 10 wherein said further pulley wheel includes means for mounting it upon one of said first and second grinding wheels.

12. The machine tool as set forth in claim 11 further including means for braking the rotation of the plurality of discs as a unit.

13. The machine tool as set forth in claim 5 including means for locating said collar off center of the axis of rotation of said first and second grinding wheels to locate the plurality of discs as a unit off center of the axis of rotation of said first and second grinding wheels and including means for repositioning said further pulley wheel to accommodate the off center location of the plurality of discs.

14. The machine tool as set forth in claim 13 including means for rotating said supporting and positioning means to permit rotation of the plurality of discs as a unit as well as rotation of each disc about its own axis of rotation in response to the forces applied to the plurality of discs by said first and second grinding wheels.

15. The machine tool as set forth in claim 14 further including means for braking the rotation of the plurality of discs as a unit.

16. The machine tool as set forth in claim 15 wherein said rotating means comprises a mounting ring secured to said machine tool, a collar and means for rotatably attaching said collar to said mounting ring.

17. A machine tool for grinding and polishing a plurality of discs simultaneously, said machine tool comprising in combination:

(a) first and second grinding wheels operating in concert for simultaneously grinding opposed surfaces of the plurality of discs, including means for selectively axially translating said first grinding wheel;

(b) means for gimbal mounting said second grinding wheel, said gimbal mounting including a shaft, a cavity disposed in said second grinding wheel for receiving said shaft, retention means for retaining said shaft within said cavity and means for rotating said second grinding wheel in response to rotation of said shaft;

(c) means for asynchronously rotating said first and second grinding wheels about respective axis of rotation having a first orientation;

(d) an openlined collar for simultaneously locating at least a part of each disc of the plurality of discs intermediate said first and second grinding wheels in a second orientation orthogonal to the first orientation; and (e) means operating in concert with said collar for establishing a three point support for and at the perimeter of each of the discs, said establishing means including means penetrating said collar and attached to said second grinding wheel for providing one point of the three point support for each of the discs and a plurality of pulley wheels disposed upon said collar.

* * * * *